US009167642B2

(12) United States Patent
Yoshimoto et al.

(10) Patent No.: US 9,167,642 B2
(45) Date of Patent: Oct. 20, 2015

(54) LED LIGHTING DEVICE AND ILLUMINATING APPARATUS USING THE SAME

(71) Applicant: Panasonic Corporation, Osaka (JP)

(72) Inventors: Yuji Yoshimoto, Hyogo (JP); Katsunobu Hamamoto, Osaka (JP); Hiroyuki Asano, Hyogo (JP); Masafumi Yamamoto, Hyogo (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 257 days.

(21) Appl. No.: 13/928,777

(22) Filed: Jun. 27, 2013

(65) Prior Publication Data

US 2014/0009077 A1 Jan. 9, 2014

(30) Foreign Application Priority Data

Jul. 5, 2012 (JP) ..... 2012-151692

(51) Int. Cl.
*H05B 37/02* (2006.01)
*H05B 33/08* (2006.01)

(52) U.S. Cl.
CPC ..... *H05B 33/0815* (2013.01); *H05B 33/0845* (2013.01)

(58) Field of Classification Search
CPC ..... H05B 33/0815; H05B 33/0818; H05B 33/0839
See application file for complete search history.

(56) References Cited

U.S. PATENT DOCUMENTS

| | | | | |
|---|---|---|---|---|
| 7,358,679 | B2 * | 4/2008 | Lys et al. | 315/51 |
| 7,759,881 | B1 * | 7/2010 | Melanson | 315/307 |
| 8,212,469 | B2 * | 7/2012 | Rains et al. | 313/503 |
| 8,339,067 | B2 * | 12/2012 | Lin et al. | 315/291 |
| 8,487,546 | B2 * | 7/2013 | Melanson | 315/291 |
| 8,643,295 | B2 * | 2/2014 | Kamata et al. | 315/206 |
| 8,648,847 | B2 * | 2/2014 | Suzuki et al. | 345/211 |
| 8,680,784 | B2 * | 3/2014 | Hariharan | 315/297 |

(Continued)

FOREIGN PATENT DOCUMENTS

| | | | |
|---|---|---|---|
| CN | 101707837 | A | 5/2010 |
| EP | 1 871 144 | A1 | 12/2007 |

(Continued)

OTHER PUBLICATIONS

Extended European Search Report for corresponding European Application No. 13172206.8 dated Nov. 20, 2013.

(Continued)

*Primary Examiner* — Jeffrey Zweizig
(74) *Attorney, Agent, or Firm* — Renner, Otto, Boisselle & Sklar, LLP

(57) ABSTRACT

An LED lighting device includes: a resistor R1 configured to output a detection value of an inductor current I1 flowing through an inductor L1 during an ON period of a switching element Q1; a threshold generation section 42 configured to generate a threshold value Vs of the inductor current I1 corresponding to a dimming level; and a switching control section 44 configured to control the switching element Q1 to turn on and off. The switching control section 44 is configured to determine an OFF timing of the switching element Q1 based on comparison between the detection value and the threshold value Vs of the inductor current I1. The LED lighting device increases a period of a switching cycle of the switching element Q1 with decrease of the dimming level.

7 Claims, 8 Drawing Sheets

(56) References Cited

U.S. PATENT DOCUMENTS

| | | | | |
|---|---|---|---|---|
| 2006/0238174 | A1 | 10/2006 | Russell et al. | |
| 2007/0188112 | A1 | 8/2007 | Kang et al. | |
| 2012/0074778 | A1* | 3/2012 | Shimomura et al. | 307/23 |
| 2012/0299512 | A1* | 11/2012 | Watanabe et al. | 315/307 |
| 2013/0293134 | A1* | 11/2013 | Ishikita et al. | 315/210 |

FOREIGN PATENT DOCUMENTS

| | | | |
|---|---|---|---|
| EP | 2 408 271 | A2 | 1/2012 |
| EP | 2 466 992 | A1 | 6/2012 |
| JP | 2002-231471 | A | 8/2002 |
| JP | 2009-301876 | A | 12/2009 |
| JP | 2010-040400 | A | 2/2010 |
| JP | 2010-218715 | A | 9/2010 |
| JP | 2011-171231 | A | 9/2011 |
| JP | 2011-204379 | A | 10/2011 |
| JP | 2012-064503 | A | 3/2012 |
| WO | WO 2007/141741 | | 12/2007 |

OTHER PUBLICATIONS

Chinese office action for corresponding Chinese Application No. 201310281827.X dated Dec. 9, 2014 (with English translation).

* cited by examiner

LED LIGHTING DEVICE AND ILLUMINATING APPARATUS USING THE SAME

TECHNICAL FIELD

The invention relates to an LED lighting device and an illuminating apparatus using the same.

BACKGROUND ART

As a lighting device adapted for lighting a light source composed of LED elements (hereinafter referred to as "LED lighting device"), there has been proposed such a lighting device that includes a chopper circuit so as to adjust (dim) the luminance of the light source. JP2002-231471A discloses a lighting device that can adjust the electric current flowing through an LED light source (hereinafter referred to as "LED current") so as to dim the LED light source by means of PWM control method. In the PWM control method, the duty ratio of a switching element included in the chopper circuit is variably controlled to adjust the LED current, so that the LED light source is lit in a desired luminance. JP2009-301876A discloses a lighting device that utilizes a first dimming signal and a second dimming signal. The first dimming signal is used for determining a dimming level, and the second dimming signal is used for determining a dimming curve. This lighting device is configured to select, based on the second dimming signal, a desired dimming curve from among a plurality of dimming curves stored in a circuit.

JP2010-40400A discloses a lighting device including a chopper circuit and a power factor corrector connected at an input side of the chopper circuit. This lighting device is configured to terminate the operation of the power factor corrector when light output of an LED element becomes lower than a predetermined level. This lighting device thereby can reduce the flicker of the LED element.

In a lighting device including a chopper circuit, energy is charged in an inductor during an ON period of the switching element, and the energy is discharged to flow an electric current during an OFF period of the switching element. The electric current varies in inverse proportion to the inductance of the inductor. Therefore, if the switching frequency is set at a low level (e.g., less than 40 [kHz]) in the lighting device which is configured to adjust the LED current based on the PWM control method, the lighting device has been required to employ a large-sized inductor with large inductance in order to reduce such a time period in which the electric current does not flow through the inductor in the OFF period.

Furthermore, when the switching frequency is set around 30 [kHz] to 40 [kHz], ripple components emerge on a waveform of the LED current to cause a flickering of light emitted by the LED element. This is likely to interfere with infrared signals emitted by a remote controller provided in another equipment. Therefore, to reduce the ripple component, a smoothing capacitor, which is to be connected in parallel with the LED element, has been required to have a large capacity.

For downsizing the inductor and/or the smoothing capacitor, there has been proposed such an LED lighting device that controls the switching element at a high-frequency. However, if the switching frequency of the switching element is set high, the ON period of the switching element may significantly be shortened (e.g., substantially 0) when the dimming level is decreased and the LED current is reduced. As a result, in the LED lighting device with a high switching frequency, when the dimming level is set low, it may be difficult to control the switching operation stably due to a delay time occurred in a control circuit for controlling the switching operation, a performance limit of the lighting device for driving the switching element, a delay time occurred in a gate-driver, or the like. That is, the conventional LED lighting device may be hard to perform stable dimming control when the dimming level is comparatively low.

DISCLOSURE OF INVENTION

The present invention is developed in view of above problem, and the object of the invention is to provide an LED lighting device that can stably control the LED light source with a desired dimming level even when the dimming level is comparatively low, and an illuminating apparatus using the same.

An LED lighting device of the present invention includes: a switching regulator; and a controller. The switching regulator includes a series circuit of a switching element, an inductor, and a capacitor, to be connected between both ends of a DC power source. The switching regulator is configured to supply an electric current to an LED light source to be connected in parallel with the capacitor. The LED light source includes at least one LED element. The controller is configured to adjust luminance of the LED light source by turning on and off the switching element in accordance with a dimming signal corresponding to a dimming level. The controller includes: a current detection section; a threshold generation section; and a threshold generation section. The current detection section is configured to output a detection value of an inductor current flowing through the inductor during an ON period of the switching element. The threshold generation section is configured to generate a threshold value of the inductor current corresponding to the dimming level. The switching control section is configured to determine an OFF timing of the switching element based on comparison between the detection value and the threshold value of the inductor current. The controller is configured to increase a period of a switching cycle of the switching element with decrease of the dimming level.

In one embodiment, the controller is configured to determine a target value of the inductor current, based on comparison between the detection value and the threshold value, so that the target value is decreased when the detection value is larger than the threshold value, and the target value is increased when the detection value is smaller than the threshold value. The controller is configured to turn off the switching element when the detection value of the inductor current is equal to or larger than the target value.

In one embodiment, the controller is configured to cause the switching element to turn on and off so that the inductor current flows in a discontinuous mode, and the discontinuous mode approaches to a critical mode with increase of the dimming level.

In one embodiment, the controller is configured to determine a target value of the inductor current corresponding to the dimming level based on the threshold value. The controller further includes a clock signal generation section configured to output a periodic clock signal. The switching control section is configured to turn off the switching element when the detection value of the inductor current increases to the target value, and turn on the switching element at the beginning of each cycle of the clock signal. The clock signal generation section is configured to lengthen a period of each cycle of the clock signal with decrease of the dimming level.

In one embodiment, the controller is configured to determine a target value of the inductor current corresponding to the dimming level based on the threshold value. The controller further includes a timer section configured to count an elapsed time from the OFF timing of the switching element. The switching control section is configured to turn off the switching element when the detection value of the inductor current increases to the target value, and turn on the switching element when the elapsed time counted by the timer section reaches a predetermined timer time. The timer section is configured to increase the timer time with decrease of the dimming level.

An illuminating apparatus of the present invention includes the LED lighting device as described above; and an apparatus body for accommodating the LED light source to which the electric current is supplied from the LED lighting device.

According to the lighting device of the invention, when the dimming level is set low, the switching frequency of the switching element becomes low. Therefore, the ON period of the switching element is avoided from being significantly shortened even when the dimming level is set low. The light device can improve the stability of the control operation even the dimming level is set low, and therefore can stably operate the LED current in a comparatively low level. In other words, the light device can perform a stable dimming operation even in a low dimming level.

DESCRIPTION OF EMBODIMENTS

Embodiments of the invention are explained below with reference to attached drawings.

First Embodiment

Figure 1:
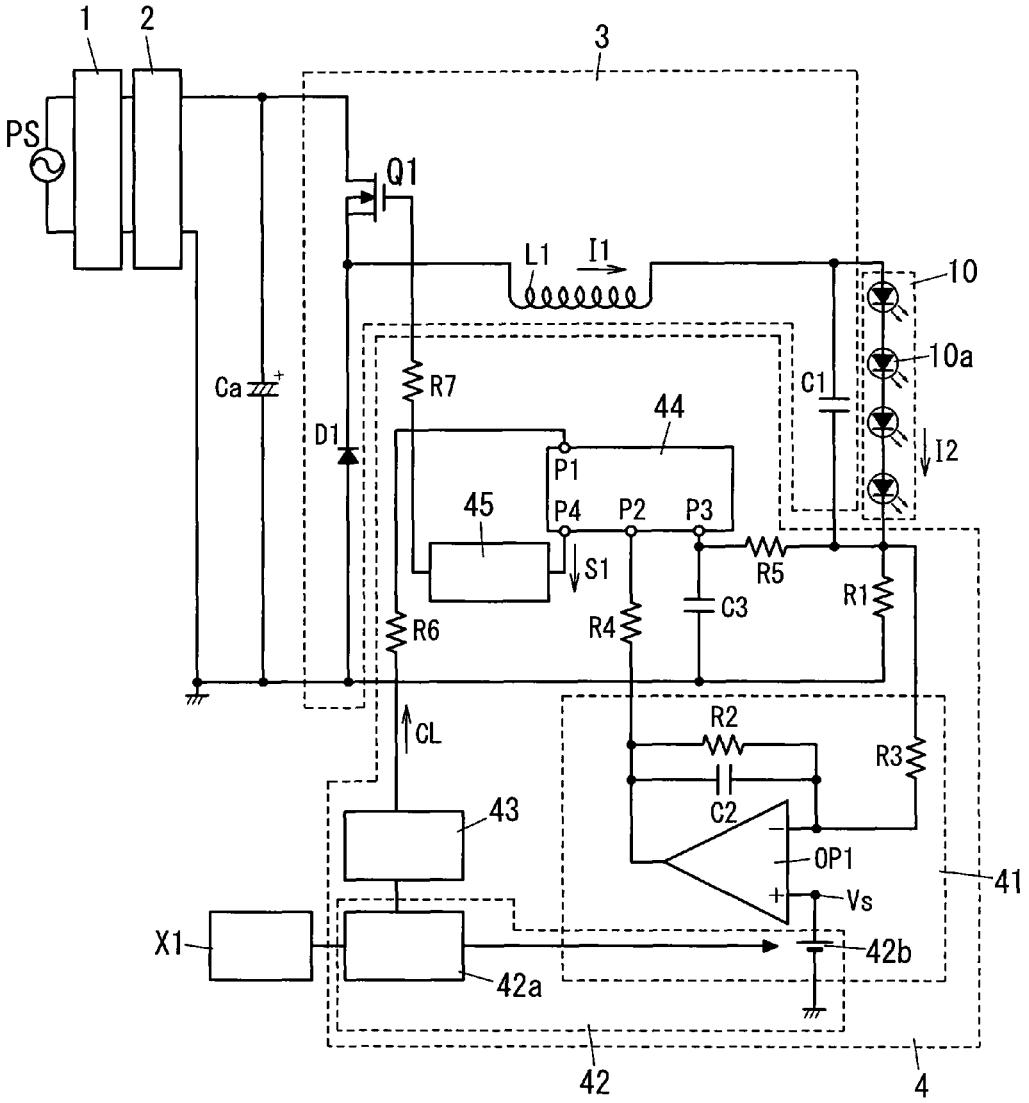
FIG. 1 is a circuit diagram showing a configuration of an LED lighting device according to a first embodiment.

FIG. 1 shows a circuit configuration of an LED (light emitting diode) lighting device according to the first embodiment.

The LED lighting device includes: a rectifier 1; a power factor corrector 2; a step-down chopper (switching regulator) 3; and a controller 4. The LED lighting device is configured to supply electric power to an LED light source (DC light source; direct-current light source) 10. The LED light source 10 includes one or more LED elements 10*a*.

An AC (alternative-current) voltage is inputted into the rectifier 1 from a commercial power source PS. The rectifier 1 is configured to rectify (e.g. full-wave rectify) the input voltage and output the rectified voltage.

The power factor corrector 2 is constituted by a boost chopper configured to boost the rectified voltage. A smoothing capacitor Ca is connected between both output terminals of the power factor corrector 2. The DC voltage (boosted voltage) is thereby applied across the terminals of the capacitor Ca. The capacitor Ca serves as a DC power source. The power factor corrector 2 constituted by the boost chopper is already know, so its detailed explanation is omitted.

The step-down chopper 3 includes a series circuit of a switching element Q1, an inductor L1, and a capacitor (smoothing capacitor) C1. The switching element Q1 is constituted by a FET (Field Effect Transistor). A high-voltage side terminal of the capacitor Ca is connected to a drain of the switching element Q1, one end (first end) of the inductor L1 is connected to a source of the switching element Q1, and the other end (second end) of the inductor L1 is connected to a high-voltage side terminal of the capacitor C1. The series circuit of the switching element Q1, the inductor L1, and the capacitor C1 is connected between the terminals of the capacitor Ca. A diode D1 is connected in parallel with a series circuit of the inductor L1 and the capacitor C1. That is, the cathode of the diode D1 is connected to the first end of the inductor L1, and a low-voltage side terminal of the capacitor C1 is connected to an anode of the diode D1. The LED light source 10 is to be connected in parallel with the capacitor C1. In the embodiment, the LED light source 10 includes a plurality of LED elements 10*a* each of which is connected in series. The step-down chopper 3 is configured to supply an electric current (LED current I2) to the LED light source 10 connected in parallel with the capacitor C1.

A resistor R1 is interposed between the LED light source 10 and the diode D1 (e.g. between the low-voltage side terminal of the capacitor C1 and the anode of the diode D1) to detect electric current. The resistor R1 serves as a current detection section. The current detection section outputs a detection value of the current (inductor current I1) flowing through the inductor L1 during the ON period of the switching element Q1.

The controller 4 is configured to control an on/off operation of the switching element Q1. The controller 4 controls switching the switching element Q1 (i.e. configured to cause the switching element Q1 to turn on and off) and adjusts the luminance of the LED light source 10. The controller 4 includes the current detection section, a dimming control section 41, a threshold generation section 42, a clock signal generation section 43, a switching control section 44, and a high-side gate driver 45.

The dimming control section 41 includes an operational amplifier (Op-Amp) OP1. A parallel circuit of a resistor R2 and a capacitor C2 is connected between an inverting input terminal and an output terminal of the Op-Amp OP1. The voltage across the resistor R1 is inputted to the inverting input terminal of the Op-Amp OP1 through a resistor R3. A non-inverting input terminal of the Op-Amp OP1 is connected to a variable voltage source 42*b* of the threshold generation section 42. The Op-Amp OP1 is configured to perform an integration operation. The output terminal of the Op-Amp OP1 is connected to an input pin (COMP terminal) P2 of the switching control section 44 with a resistor R4 interposed therebetween.

The switching control section 44 is constituted by e.g. a control IC including a chopper circuit having a critical mode control function. The switching control section 44 is configured to determine an OFF timing of the switching element Q1 (i.e. configured to determine the timing of turning off the switching element Q1) based on comparison between the detection value of the inductor current I1 and a threshold value Vs generated by the threshold value generation section 42.

The switching control section 44 includes input pins (P1, P2 and P3) and an output pin P4.

In conventional configurations, a detection value of an inductor current of a chopper circuit is inputted into the input pin (ZCD terminal) P1. The switching control section 44 is configured to detect such a state that the detection value of the inductor current (inputted to the input pin P1) reduces to almost zero, that is, the switching control section 44 has a function of detecting a zero-cross timing of the detection value of the inductor current. In the conventional configurations, upon detecting the zero-cross of the detection value of the inductor current, the switching control section 44 switches a control signal S1 to H-level, which is to be outputted from the output pin (OUT terminal) P4, and turns on the switching element Q1.

In the embodiment, a clock signal CL generated by the clock signal generation section 43 is inputted into the input pin P1 through a resistor R6. Upon detecting the zero-cross of the clock signal CL, the switching control section 44 switches the control signal S1 to H-level, which is to be outputted from the output pin P4, and turns on the switching element Q1 (e.g. see FIGS. 3B, 3C).

In the switching control section 44, the output of the Op-Amp OP1 is inputted into the input pin (COMP terminal) P2, and the detection value of the inductor current I1 measured through the resistor R1 is inputted into the input pin (CS terminal) P3. A series circuit of a resistor R5 and a capacitor C3 is connected between both ends of the resistor R1, and a connection point of the resistor R5 and the capacitor C3 is connected to the input pin P3. The series circuit of the resistor R5 and the capacitor C3 serves as a low-pass filter to block a high-frequency component of the detection value (i.e. voltage generated across the resistor R1) of the inductor current I1. The switching control section 44 includes a built-in constant current source for performing source/sink operations. The switching control section 44 is configured to generate a target value Is of the inductance current I1 in accordance with the voltage of the input pin P2. When the detection value (voltage of the input pin P3) of the inductor current I1 is larger than the target value Is, the switching control section 44 switches the control signal S1 to L-level, which is to be outputted from the output pin P4, and turns off the switching element Q1.

The switching element Q1 is connected to the high-voltage side output terminal of the power factor corrector 2. The high-side gate driver 45 is configured to shift a level of the control signal S1 outputted by the switching control section 44, and then applies the shifted signal onto the gate of the switching element Q1 through a resistor R7, thereby controlling the ON/OFF operation of the switching element Q1.

An operation of the LED lighting device for adjusting the luminance level is described below.

A dimming instruction signal is inputted into the threshold generation section 42 from a dimming instruction signal output section X1. The dimming instruction signal corresponds to a dimming level of the LED light source 10. The LED lighting device is configured to increase the luminance of the LED light source 10 with increase of the dimming level.

A signal conversion section 42*a* in the threshold generation section 42 is configured to convert the dimming instruction signal into a DC voltage signal (hereinafter, referred to as "dimming signal"). An output voltage of a variable voltage source 42*b* is adjusted in accordance with the diming signal sent from the signal conversion section 42*a*. The variable voltage source 42*b* is configured to generate a higher DC voltage, as the threshold value Vs, with increase of the dimming level corresponding to the dimming signal. The output voltage of the variable voltage source 42*b* is inputted, as "the threshold value Vs", into the non-inverting input terminal of the Op-Amp OP1.

In cases where placed outside the LED lighting device, the dimming instruction signal output section X1 may include a dimmer for outputting a duty signal or a digital signal corresponding to the dimming level, a controller, and the like. The dimming instruction signal may be transmitted by cable or wireless means (e.g. through a radio wave or infrared wave). In cases where placed inside the LED lighting device, the dimming instruction signal output section X1 may include a micro computer or the like.

The dimming instruction signal output section X1 may adjust the dimming instruction signal according to a predetermined program. For example, time schedule of the dimming level of the LED light source 10 may be preliminarily determined (i.e., the dimming level of the LED light source 10 may be changed at a predetermined time of day). This configuration can promote an energy saving effect.

The Op-Amp OP1 compares the detection value of the inductor current I1 measured through the resistor R1 with the threshold value Vs inputted from the threshold generation section 42. When the detection value of the inductor current I1 is larger than the threshold value Vs, the output terminal of the Op-Amp OP1 performs a sink-operation (i.e., electric current flows from the input pin P2 to the output terminal of the Op-Amp OP1). When the output terminal of the Op-Amp OP1 performs the sink-operation, the voltage of the input pin P2 of the switching control section 44 gradually decreases.

The switching control section 44 generates the target value Is of the inductor current I1 corresponding to the voltage of the input pin P2. The switching control section 44 decreases the target value Is of the inductor current I1 with decrease of the voltage of the input pin P2. When the detection value of the inductor current I1 inputted into the input pin P3 becomes equal to or larger than the target value Is, the switching control section 44 switches the control signal S1 to L-level and turns off the switching element Q1.

Therefore, when the detection value of the inductor current I1 is larger than the threshold value Vs, the switching control section 44 decreases the target value Is of the inductor current I1 in response to the decrease in the voltage of the input pin P2, thereby advancing the OFF timing of the switching element Q1. The ON period of the switching element Q1 is therefore shortened and the LED current I2 flowing through the LED light source 10 decreases.

The switching control section 44 adjusts the target value Is so as to decrease the LED current I2, thereby decreasing the detection value of the inductor current I1. When the detection value of the inductor current I1 becomes equal to the threshold value Vs, the output terminal of the Op-Amp OP1 stops the sink-operation.

On the other hand, the Op-Amp OP1 compares the detection value of the inductor current I1, which is measured through the resistor R1, with the threshold value Vs inputted from the threshold generation section 42, and when the detection value of the inductor current I1 is smaller than the threshold value Vs, the output terminal of the Op-Amp OP1 performs a source-operation (i.e., electric current flows from the output terminal of the Op-Amp OP1 to the input pin P2). When the output terminal of the Op-Amp OP1 performs the source-operation, the voltage of the input pin P2 of the switching control section 44 gradually increases.

The switching control section 44 generates the target value Is of the inductor current I1 corresponding to the voltage of the input pin P2. The switching control section 44 increases the target value Is of the inductor current I1 with increase of the voltage of the input pin P2.

Therefore, when the detection value of the inductor current I1 is smaller than the threshold value Vs, the switching control section 44 increases the target value Is of the inductor current I1 in response to the increase in the voltage of the input pin P2, thereby delaying the OFF timing of the switching element Q1. The ON period of the switching element Q1 is, therefore, lengthened and the LED current I2 flowing through the LED light source 10 increases.

Consequently, the controller 4 of the embodiment is configured to determine the target value Is corresponding to the dimming level by use of the threshold value Vs and turn off the switching element Q1 at the time when the detection value of the inductor current I1 becomes equal to or larger than the target value Is. The controller 4 is configured to determine that the target value Is decreases as the dimming level is reduced.

That is, the controller 4 of the embodiment includes the dimming control section 41 configured to compare the detection value of the inductor current I1 with the threshold value Vs. The switching control section 44 in the controller 4 is configured to determine the target value Is based on the comparison result of the dimming control section 41. The switching control section 44 is configured to decrease the target value Is when the detection value of the inductor current I1 exceeds the threshold value Vs, and increase the target value Is when the detection value of the inductor current I1 falls below the threshold value Vs. The switching control section 44 is configured to turn off the switching element Q1 at the time when the detection value of the inductor current I1 becomes equal to or larger than the target value Is.

According to the embodiment, the higher the dimming level is, the more the OFF timing of the switching element Q1 is delayed to increase the LED current I2, whereas the lower the dimming level is, the more the OFF timing of the switching element Q1 is advanced to decrease the LED current I2. With this configuration therefore, the luminance of the LED light source 10 can be varied in accordance with the dimming level.

Figure 2:
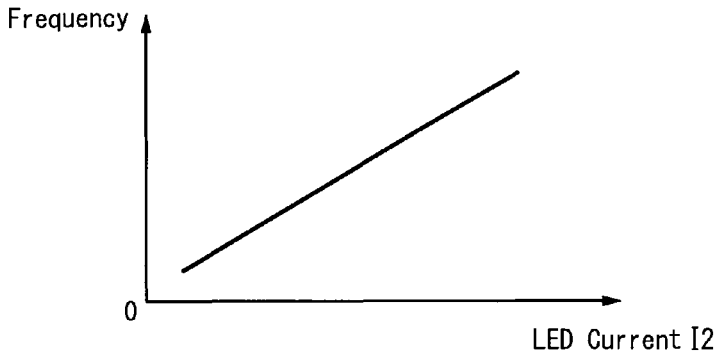
FIG. 2 is a graph chart showing a frequency characteristic of a clock signal of the LED lighting device according to the first embodiment.

The dimming signal generated by the signal conversion section 42*a* is also inputted into the clock signal generation section 43. The clock signal generation section 43 is configured to output a periodic clock signal CL which alternates between H-level and L-level based on the dimming signal sent from the signal conversion section 42*a*. The clock signal generation section 43 varies the frequency of the clock signal CL in accordance with the voltage value of the dimming signal inputted from the signal conversion section 42*a*. That is, the clock signal generation section 43 varies the frequency of the clock signal in accordance with the dimming signal corresponding to the dimming level. As shown in FIG. 2, the clock signal generation section 43 increases the frequency of the clock signal CL when the dimming level is set high (i.e., the voltage value of the dimming signal is high) to increase the LED current I2, and decreases the frequency of the clock signal CL when the dimming level is set low (i.e., the voltage value of the dimming signal is low) to decrease the LED current I2.

The clock signal CL generated by the clock signal generation section 43 is inputted into the input pin P1 of the switching control section 44. At zero-cross timing of the clock signal CL (i.e., at the beginning of each cycle of the clock signal CL), the switching control section 44 switches the control signal S1 to H-level, which is to be outputted from the output pin P4, and turns on the switching element Q1.

Therefore, the controller 4 is configured to increase the period of the switching cycle of the switching element Q1 (i.e., decrease the frequency of the switching element Q1) with decrease of the dimming level.

In summarize, the controller 4 is configured to determine the target value Is corresponding to the dimming level by use of the threshold value Vs. The controller 4 determines the target value Is, based on the threshold value Vs, to decrease the target value Is with decrease of the dimming level. The controller 4 includes the clock signal generation section 43 configured to output the periodic clock signal CL. The switching control section 44 is configured to turn off the switching element Q1 when the detection value of the inductor current I1 becomes equal to or larger than the target value Is, and turn on the switching element Q1 at the beginning of each cycle of the clock signal CL. The clock signal generation section 43 determines a period of each cycle of the clock signal CL, based on the dimming level, to increase the period with decrease of the dimming level.

Figure 3:
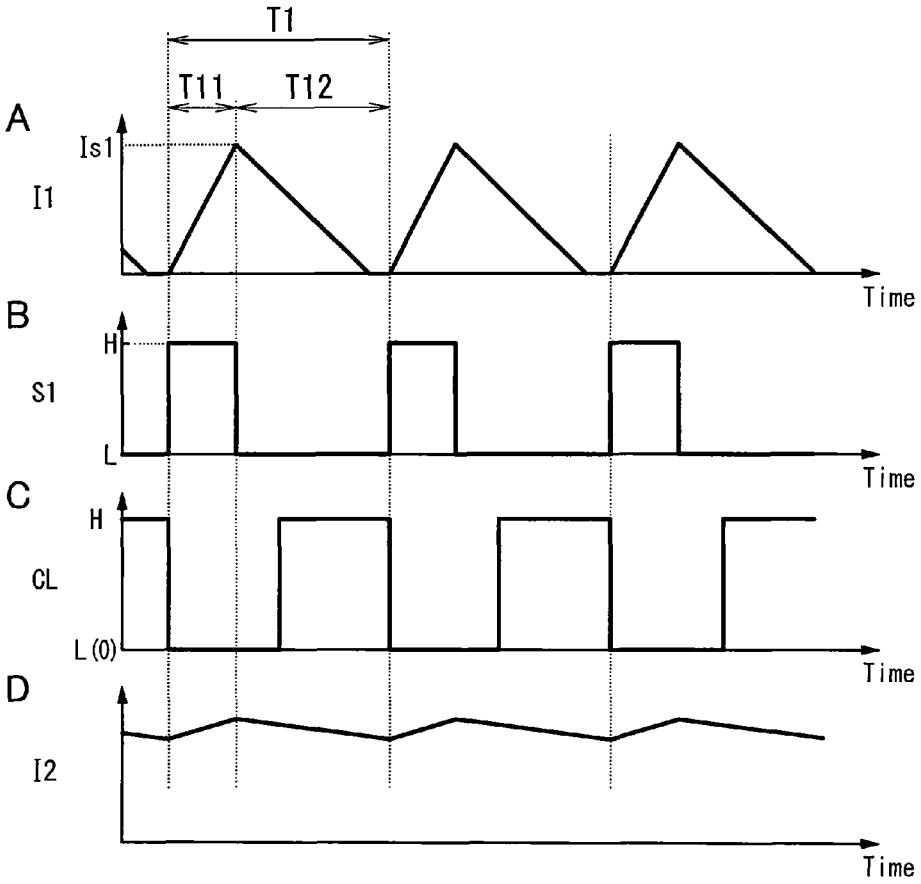
FIGS. 3A to 3D are waveform diagrams for explaining the operation of the LED lighting device according to the first embodiment when the dimming level is set comparatively high.

FIG. 3 shows waveforms of signals/currents of some components of the embodiment when the dimming level is set comparatively high. FIG. 3A is a waveform diagram of the inductor current I1, FIG. 3B is a waveform diagram of the control signal S1, FIG. 3C is a waveform diagram of the clock signal CL, and FIG. 3D is a waveform diagram of the LED current I2. With regard to the period of each cycle of the clock signal CL (a period of the switching cycle of the switching element Q1), in cases where the dimming level is set comparatively high, the clock signal CL has a shorter period T1. When the inductor current I1 reaches the target value Is1 which is comparatively high, the switching element Q1 is switched from ON state to OFF state. As a result, the ON period T11 of the switching element Q1 is lengthened comparatively and the OFF period T12 is shortened comparatively.

Figure 4:
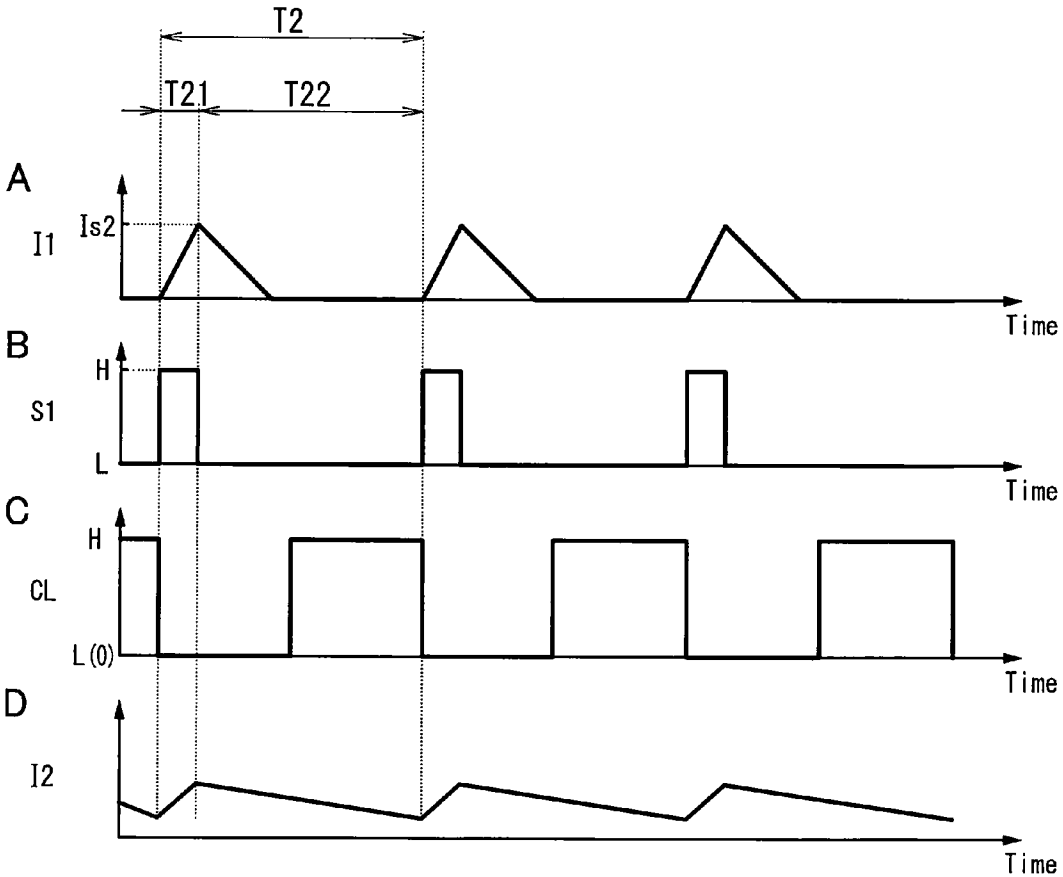
FIGS. 4A to 4D are waveform diagrams for explaining the operation of the LED lighting device according to the first embodiment when the dimming level is set comparatively low.

FIG. 4 shows waveforms of signals/currents of some components of the embodiment when the dimming level is set comparatively low. FIG. 4A is a waveform diagram of the inductor current I1, FIG. 4B is a waveform diagram of the control signal S1, FIG. 4C is a waveform diagram of the clock signal CL, and FIG. 4D is a waveform diagram of the LED current I2. With regard to the period of each cycle of the clock signal CL (a period of the switching cycle of the switching element Q1), in cases where the dimming level is set comparatively low, the clock signal CL has a longer period T2 (>T1). When the inductor current I1 reaches a lower target value Is2 (<Is1), the switching element Q1 is switched from ON state to OFF state. As a result, the ON period of the switching element Q1 is shortened to T21 (<T11) and the OFF period is lengthened to T22 (>T12).

Therefore, the controller 4 of the embodiment is configured to control the switching element Q1 as follows: with decrease of the dimming level, lengthen the period of the switching cycle of the switching element Q1; shorten the ON period of the switching element Q1; and lengthen the OFF period of the switching element Q1.

As shown in FIG. 3, when the dimming level is set to a high level, the step-down chopper 3 operates the inductor current I1 in its discontinuous mode approximate to its critical mode. Therefore, the inductance of the inductor L1 can be made small compared with the case where the step-down chopper 3 operates the inductor current I1 in its continuous mode.

Note that, the current, which flows out of the inductor L1 during the OFF period of the switching element Q1, varies in inverse proportion to the inductance of the inductor L1 and in proportion to the voltage applied on the LED light source 10. Therefore, in cases where the inductance of the inductor L1 is small and the dimming level is set high (i.e., the voltage applying on the LED light source 10 is large), the current, which flows out of the inductor L1, rapidly decreases and causes the state where no inductor current flows during the OFF period. On the contrary, according to the controller 4 of the embodiment, when the dimming level is set comparatively high, the period of the switching cycle of the switching element Q1 is shortened and therefore the OFF period of the switching element Q1 is decreased (i.e., shorten the state where no inductor current I1 flows during the OFF period). That is, as the dimming level is increased, the step-down chopper 3 can operate the inductor current I1 in near the critical mode. Therefore, the LED light source is lit on at a high dimming level without increasing the inductance of the inductor L1 (i.e., without increasing the physical size of the inductor L1).

As shown in FIG. 4, when the dimming level is set low, the step-down chopper 3 operates the inductor current I1 in the discontinuous mode. In the discontinuous mode, to supply the LED current I2 during the OFF period of the switching element Q1, the smoothing capacitor C1 is usually required to have a comparatively large capacitance. On the contrary, in the embodiment, less energy is consumed in the LED light source 10 because the LED current I2 is made low when the dimming level is set low. This makes the capacitance of the smoothing capacitor C1 comparatively small, thereby miniaturizing the smoothing capacitor C1.

Note that, in the discontinuous mode, the inductor current I1 temporarily falls to zero during the OFF period of the switching element Q1 (i.e., the inductor current I1 flows intermittently). In the critical mode, the switching element Q1 is turned on at the time when the inductor current I1 falls to substantially zero. In the continuous mode, the inductor current I1 flows continuously regardless of the ON/OFF state of the switching element Q1.

When the dimming level is set low, the switching frequency of the switching element Q1 is made low (i.e., the period of switching cycle of the switching element Q1 is lengthened). Therefore, according to the embodiment, the ON period of the switching element Q1 is avoided from being significantly shortened (i.e., the ON period does not become substantially zero) even when the dimming level is set low (see the ON period T21 in FIG. 4). The embodiment can improve the stability of the control operation even when the dimming level is set low, and therefore can stably operate the LED current I2 in a lower level. In other words, the embodiment can perform a stable dimming operation even when the dimming level is set low, thereby widening the range of dimming.

Note that, as exemplified in FIG. 4D, the controller 4 of the embodiment is configured to determine the period of the switching cycle of the switching element Q1 so that the LED current I2 (electric current supplied from the step-down chopper 3 to the LED light source 10) exceeds a predetermined value even when the ON period of the switching element Q1 is set minimum. In other words, the minimum frequency of the clock signal CL (and minimum value of the threshold value Vs) is determined so that the LED current I2 exceeding the predetermined value flows even when the ON period of the switching element Q1 is set minimum, in light of the inductance of the inductor L1 and/or the capacitance of the capacitor C1.

Figure 5:
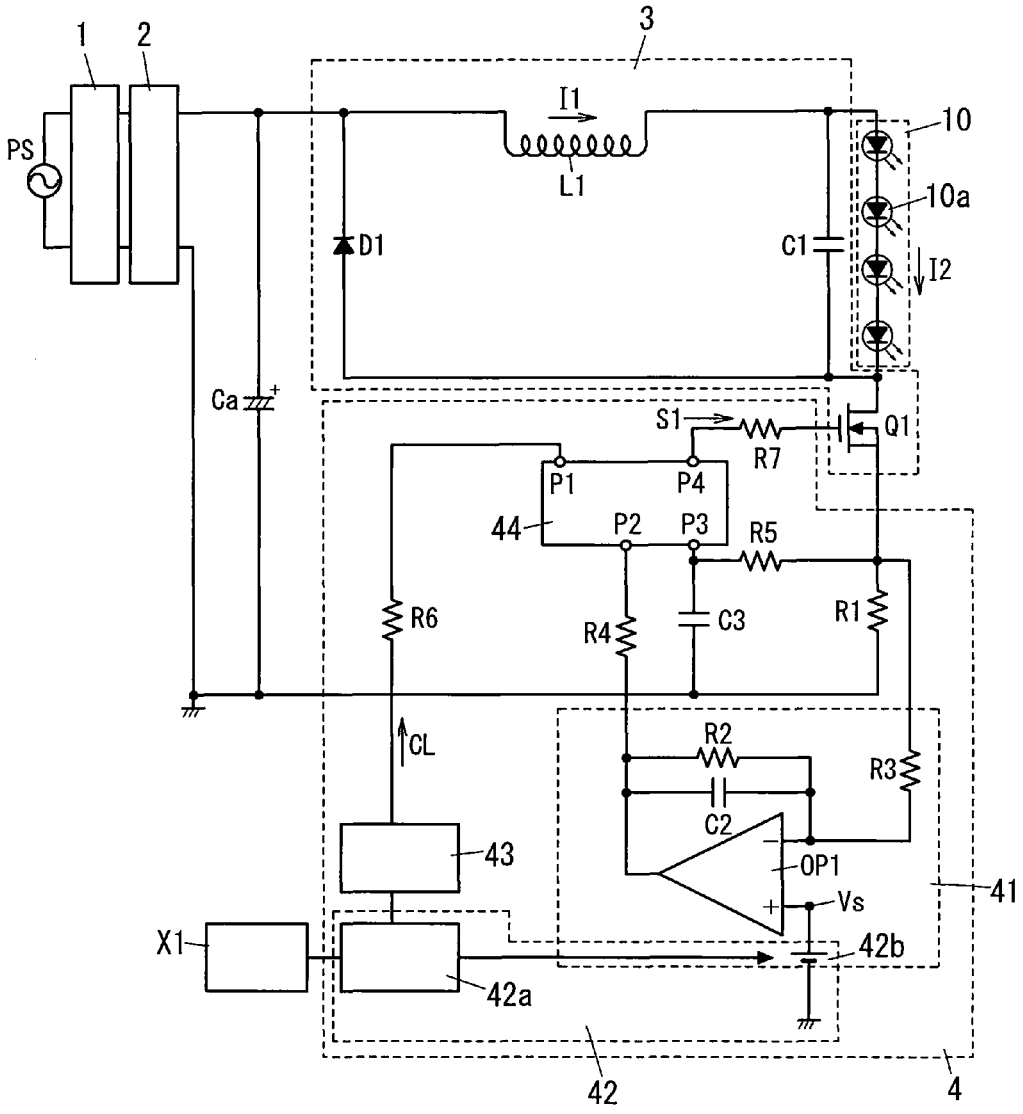
FIG. 5 is a circuit diagram showing a configuration of another LED lighting device according to the first embodiment.

In the configuration shown in FIG. 1, the switching element Q1 is connected to a high-voltage side of the power factor corrector 2, but not limited to this. That is, the switching element Q1 may be connected to a low-voltage side of the power factor corrector 2, as shown in FIG. 5. In this configuration, the high-side gate driver 45 is not necessary. The output pin P4 of the switching control section 44 may be connected to the gate of the switching element Q1 through a resistor R7.

In the embodiment, the switching control section 44 employs a control IC including the chopper circuit that operates in a critical mode, but not limited to this. Another type of control IC, which operates in the similar manner, may be employed. Further, the dimming control section 41, the clock signal generation section 43, and the switching control section 44 may be integrated to provide a single IC.

Second Embodiment

Figure 6:
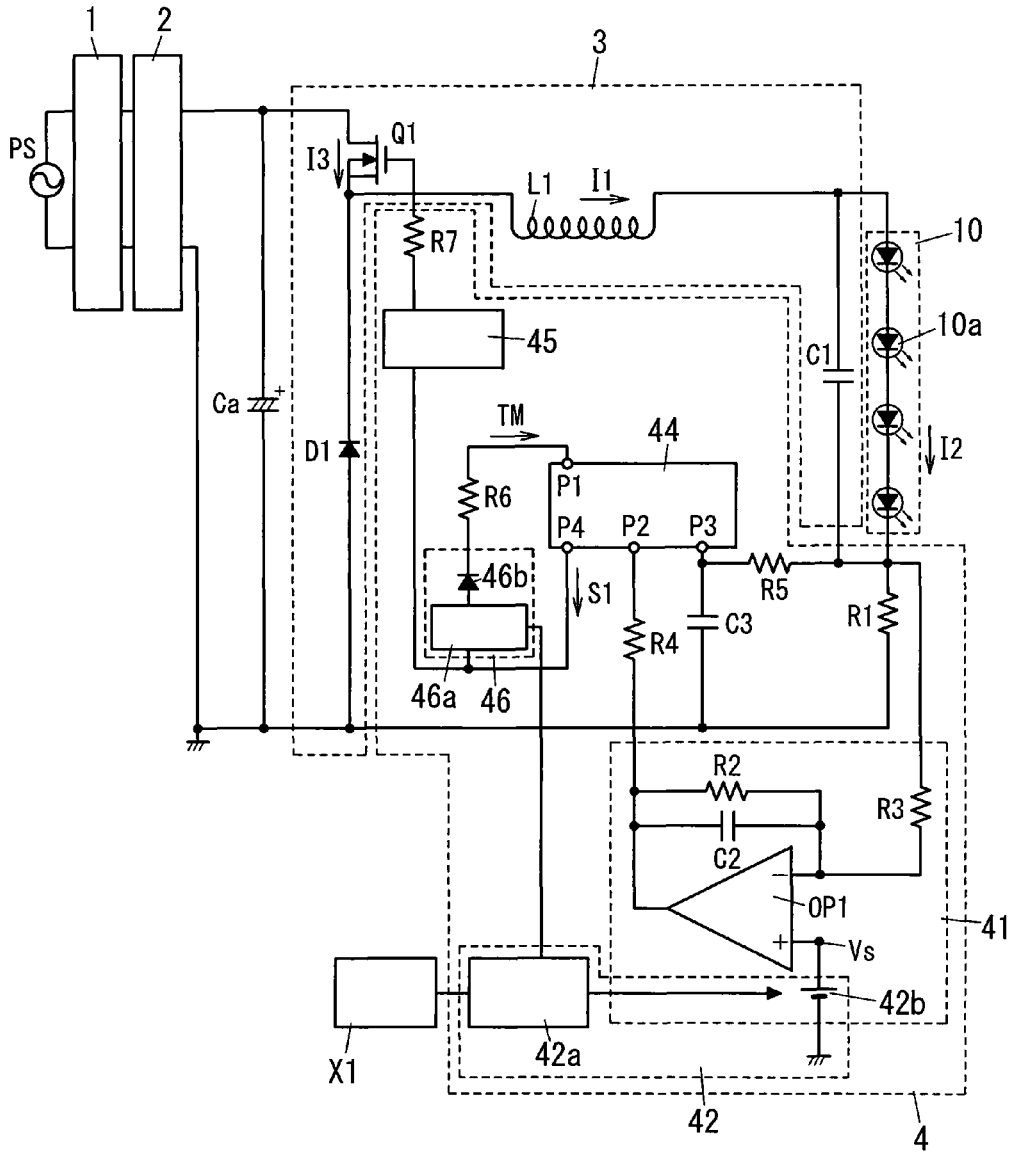
FIG. 6 is a circuit diagram showing a configuration of an LED lighting device according to a second embodiment.

FIG. 6 shows a circuit configuration of an LED lighting device according to the second embodiment.

The embodiment includes a timer section 46 configured to control the ON timing of the switching element Q1 (i.e., configured to determine the timing of turning on the switching element Q1), instead of the clock signal generation section 43. The same elements are assigned the same reference numerals as depicted in the first embodiment, and the detailed explanation is omitted.

The timer section 46 includes a timer circuit 46*a* and a diode 46*b*. The timer circuit 46*a* is configured to output a timer signal TM, which is determined based on the dimming signal transmitted from the signal conversion section 42*a*, to the input pin P1 of the switching control section 44 through the diode 46*b*. When the control signal S1 sent from the output pin P4 of the switching control section 44 is in H-level, the timer circuit 46*a* outputs the timer signal TM of H-level. The timer circuit 46*a* is configured to count an elapsed time from when the control signal S1 is switched from H-level to L-level. When the elapsed time reaches a timer time Ta, the timer section 46 switches the timer signal TM from H-level to L-level. That is, the timer section 46 is configured to count the elapsed time from when the switching element Q1 is turned off, and notify the switching control section 44 when the elapsed time reaches the timer time Ta (predetermined).

Figure 7:
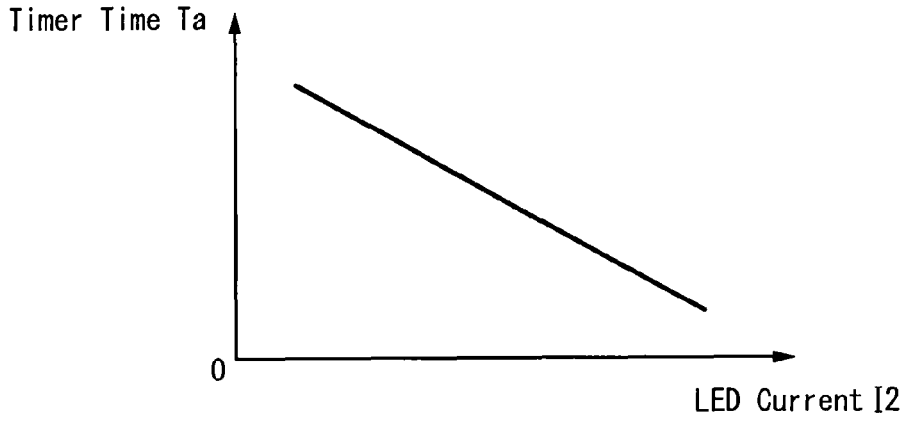
FIG. 7 is a graph chart showing a characteristic of a timer time in a timer signal of the LED lighting device according to the second embodiment.

The timer circuit 46*a* changes the timer time Ta in accordance with the voltage of the dimming signal sent from the signal conversion section 42*a*. That is, the timer section 46 changes the timer time Ta in accordance with the dimming signal. As shown in FIG. 7, the timer circuit 46*a* is configured to shorten the timer time Ta when the LED current I2 is large and the dimming level is set at a high level (i.e., the voltage value of the dimming signal is high), whereas lengthen the timer time Ta when the LED current I2 is small and the dimming level is set at a low level (i.e., the voltage value of the dimming signal is low).

At a zero-cross timing of the timer signal TM (i.e., switch the timer signal TM from H-level to L-level), the switching control section 44 switches the control signal S1 to H-level, which is to be outputted from the output pin P4, and turns on the switching element Q1. That is, the switching control section 44 is configured to switch the control signal S1 to H-level and turn on the switching element Q1 in synchronization with the zero-cross timing of the time signal TM.

Therefore, the controller 4 is configured to lengthen the period of the switching cycle of the switching element Q1 (i.e., decrease the switching frequency of the switching element Q1) with decrease of the dimming level.

In summarize, the controller 4 is configured to determine the target value Is corresponding to the dimming level by use of the threshold value Vs. The controller 4 is configured to determine, based on the threshold value Vs, the target value Is so that the target value Is is made lower with decrease of the dimming level. The controller 4 includes the timer section 46 configured to count the elapsed time from the OFF timing of the switching element Q1. The switching control section 44 is configured to turn off the switching element Q1 when the detection value of the inductor current I1 becomes equal to or larger than the target value Is, and turn on the switching element Q1 when the elapsed time counted by the timer section 46 reaches the timer time Ta. The timer section 46 determines the timer time Ta, based on the dimming level, to lengthen the timer time Ta with decrease of the dimming level.

Figure 8:
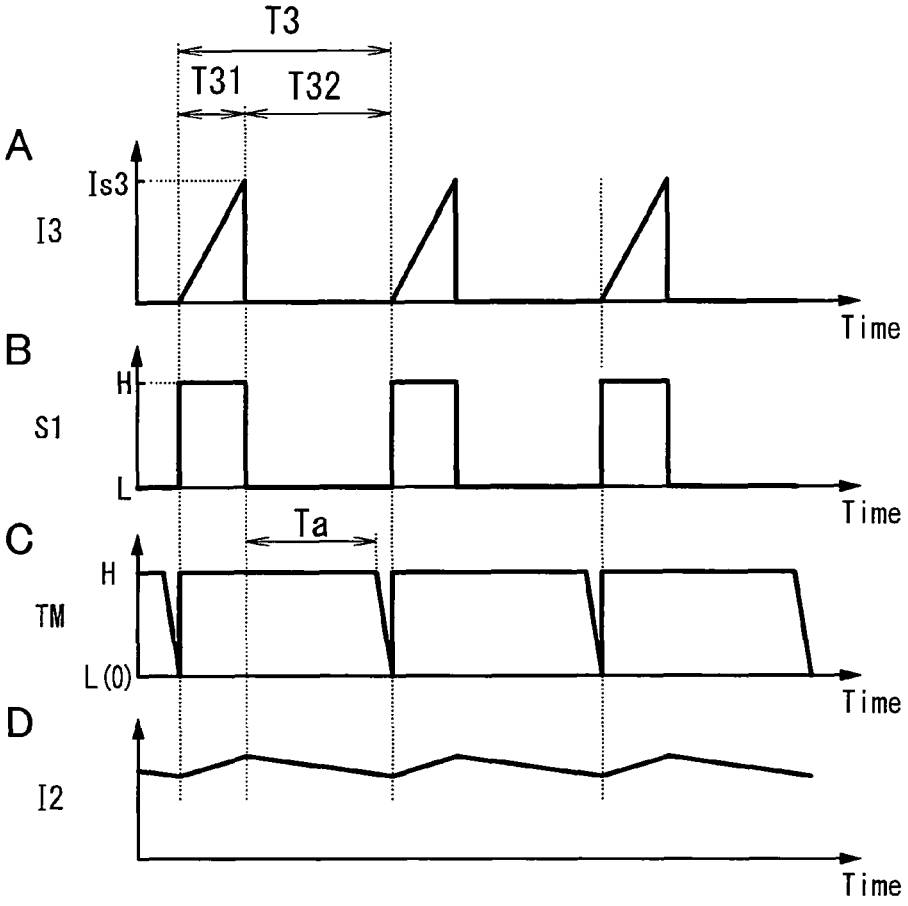
FIGS. 8A to 8D are waveform diagrams for explaining the operation of the LED lighting device according to the second embodiment when the dimming level is set comparatively high.

FIG. 8 shows waveforms of signals/currents of some components of the embodiment when the dimming level is set comparatively high. FIG. 8A is a waveform diagram of a switching current I3 flowing through the switching element Q1, FIG. 8B is a waveform diagram of the control signal S1, FIG. 8C is a waveform diagram of the timer signal TM, and FIG. 8D is a waveform diagram of the LED current I2. With regard to a period of each cycle of the timer signal TM (the period of the switching cycle of the switching element Q1), in cases where the dimming level is set comparatively high, the timer signal TM has a comparatively short period T3. The switching element Q1 is switched from ON state to OFF state when the switching current I3 reaches a target value Is3 which is comparatively high. As a result, the ON period T31 of the switching element Q1 becomes comparatively long and the OFF period T32 becomes comparatively short. Note that, the switching current I3 is proportional to the inductor current I1 during the ON period T31.

Figure 9:
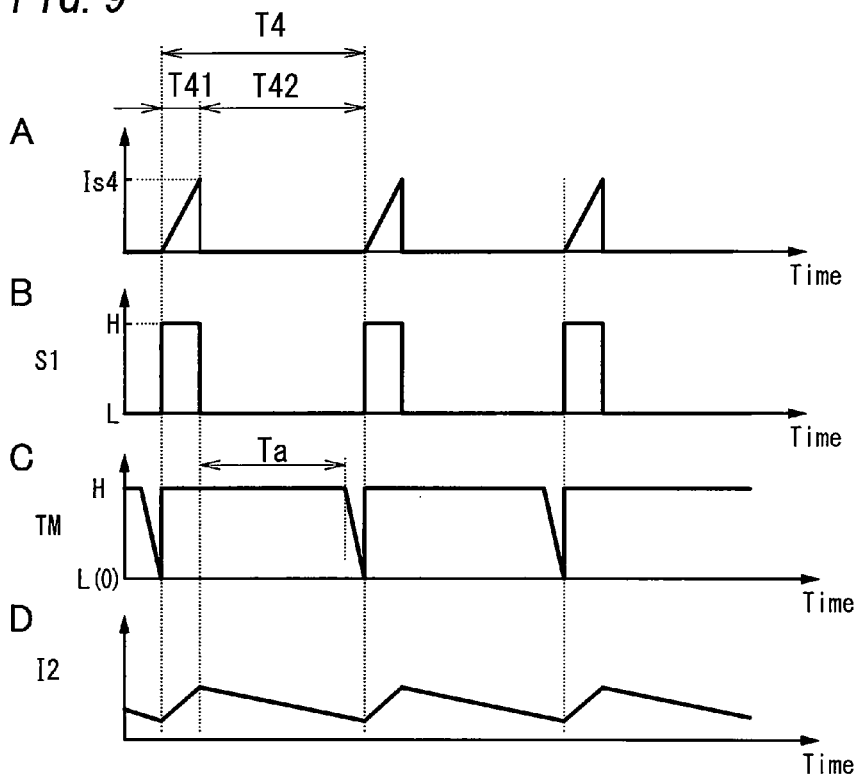
FIGS. 9A to 9D are waveform diagrams for explaining the operation of the LED lighting device according to the second embodiment when the dimming level is set comparatively low.

FIG. 9 shows waveforms of signals/currents of some components of the embodiment when the dimming level is set comparatively low. FIG. 9A is a waveform diagram of the switching current I3, FIG. 9B is a waveform diagram of the control signal S1, FIG. 9C is a waveform diagram of the timer signal TM, and FIG. 9D is a waveform diagram of the LED current I2. With regard to the period of each cycle of the timer signal TM (the period of the switching cycle of the switching element Q1), in cases where the dimming level is set comparatively low, the timer signal TM has a longer period T4 (>T3). The switching element Q1 is switched from ON state to OFF state when the switching current I3 reaches a smaller target value Is4 (<Is3). As a result, the ON period of the switching element Q1 is shortened to T41 (<T31) and the OFF period is lengthened to T42 (>T32). Note that, the switching current I3 is proportional to the inductor current I1 during the ON period T41.

The controller 4 of the embodiment is configured to control the switching element Q1 as follows: with decrease of the dimming level, lengthen the period of the switching cycle of the switching element Q1; shorten the ON period of the switching element Q1; and lengthen the OFF period of the switching element Q1.

When the dimming level is set high, the step-down chopper 3 operates the inductor current I1 in the discontinuous mode approximate to the critical mode. Therefore, the inductance of the inductor L1 can be made small compared with the case where the step-down chopper 3 operates the inductor current I1 in the continuous mode.

In addition, when the dimming level is set comparatively high, the period of the switching cycle of the switching element Q1 is shortened and therefore the OFF period of the switching element Q1 is decreased (i.e., shorten the state where no inductor current I1 flows during the OFF period). Therefore, the LED light source is lit on at a high dimming level without increasing the inductance of the inductor L1 (i.e., without increasing the physical size of the inductor L1).

When the dimming level is set low, the step-down chopper 3 operates the inductor current I1 in the discontinuous mode. In the embodiment, less energy is consumed in the LED light source 10 because the LED current I2 is made low when the dimming level is set low. This makes the capacitance of the smoothing capacitor C1 comparatively small, thereby miniaturizing the smoothing capacitor C1.

When the dimming level is set low, the switching frequency of the switching element Q1 is made low (i.e., the period of the switching cycle of the switching element Q1 is lengthened). Therefore, according to the embodiment, the ON period of the switching element Q1 is avoided from being significantly shortened (i.e., the ON period does not become substantially zero) even when the dimming level is set low (see the ON period T41 in FIG. 9). The embodiment can improve the stability of the control operation even when the dimming level is set low, and therefore can stably operate the LED current I2 in a lower level. In other words, the embodiment can perform a stable dimming operation even when the dimming level is low, thereby widening the range of dimming.

Note that, as exemplified in FIG. 9D, the controller 4 of the embodiment is configured to determine the period of the switching cycle of the switching element Q1 so that the LED current I2 (electric current supplied from the step-down chopper 3 to the LED light source 10) exceeds a predetermined value even when the ON period of the switching element Q1 is set minimum. In other words, the maximum value of the timer time Ta of the timer signal TM (and the minimum value of the threshold value Vs) is determined so that the LED current I2 exceeds the predetermined value even when the ON period of the switching element Q1 is set minimum, in light of the inductance of the inductor L1 and/or the capacitance of the capacitor C1.

In a configuration shown in FIG. 6, the switching element Q1 is connected to a high-voltage side of the power factor corrector 2, but not limited to this. The switching element Q1 may be connected to a low-voltage side of the power factor corrector 2. In this configuration, the high-side gate driver 45 is not necessary. The output pin P4 of the switching control section 44 may be connected to the gate of the switching element Q1 through a resistor R7.

Note that, the dimming control section 41, the switching control section 44 and the timer section 46 can be integrated to provide a single IC.

The other configurations of the embodiment is identical to those of the first embodiment, and the detailed explanations thereof are omitted.

Third Embodiment

Figure 10:
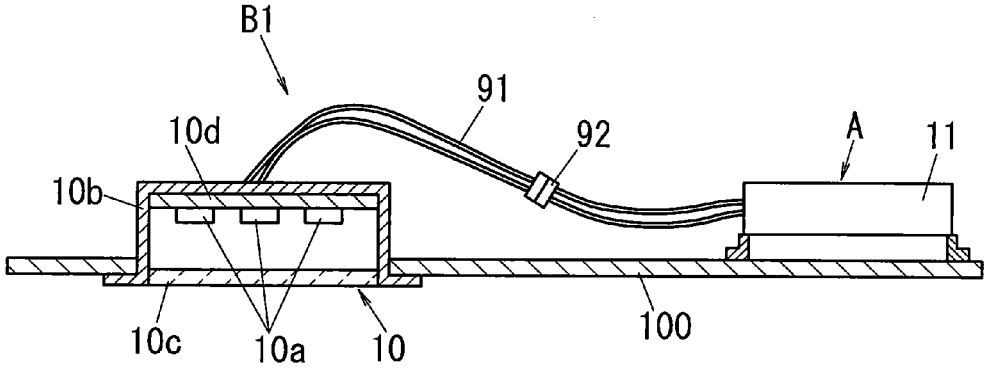
FIG. 10 is a sectional view showing a configuration of an illuminating apparatus according to a third embodiment.

FIG. 10 shows a schematic configuration of an illuminating apparatus B1 of a power source separation type, which uses the LED lighting device (hereinafter referred to as "LED lighting device A") described in the first and the second embodiment.

In this illuminating apparatus B1, the LED lighting device A is accommodated in a case 11 which is provided separately from an apparatus body 10*b* of LED light source 10. Therefore, the thickness of the LED light source 10 can be reduced, and also the size of the LED light source A can be reduced as a separation type power source. This configuration expands the degree of freedom for arranging the illuminating apparatus.

The apparatus body 10*b* for the LED light source 10 is formed into a cylindrical shape whose one surface side (lower side) is opened. The opened surface is covered with a light diffusing plate 10*c*. A mounting substrate 10*d* is arranged on a bottom of the other surface side (upper side) of the apparatus body 10*b*. A plurality of the LED elements 10*a* are mounted on the mounting substrate 10*d*.

The apparatus body 10*b* is buried in a ceiling 100. The LED light source 10 is connected to the LED lighting device A, which is arranged behind the ceiling, through lead wires 91 and connectors 92.

Figure 11:
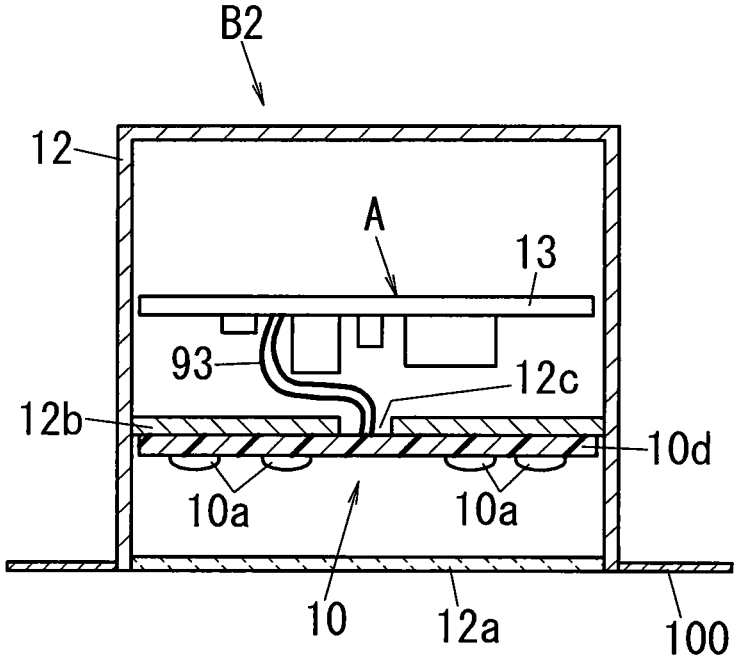
FIG. 11 is a sectional view showing a configuration of another illuminating apparatus according to the third embodiment.

FIG. 11 shows a schematic configuration of an illuminating apparatus B2 of a power source integrated type. The LED lighting device A and the LED light source 10 are arranged inside an apparatus body 12 of the illuminating apparatus B2.

The apparatus body 12 is formed into a cylindrical shape whose one surface side (lower side) is opened. The opened surface is covered with a light diffusing plate 12*a*. The inside space of the apparatus body 12 is separated by a separation plate 12*b* to provide one surface side (lower side) and the other surface side (upper side). The LED light source 10 is disposed on the lower side of the separation plate 12*b* so as to face the light diffusing plate 12*a*. The LED light source 10 includes a mounting substrate 10*d* on which a plurality of LED elements 10*a* are mounted. The LED lighting device A is accommodated in the upper side of the separation plate 12*b*, in which a plurality of components constituting the LED lighting device A are mounted on the mounting substrate 13.

The separation plate 12*b* has an opening 12*c* formed therethrough. The LED light source 10 is connected to the LED lighting source A through a lead wire 93 which passes through the opening 12*c*.

The apparatus body 12 is buried in the ceiling 100.

The LED lighting device of the invention may be applied, not limited to an illuminating apparatus, to a backlight of a liquid-crystal display, a light source of a copy machine, scanner and projector, and the like.

The invention claimed is:

1. An LED lighting device comprising:

a switching regulator that includes a series circuit of a switching element, an inductor, and a capacitor, to be connected between both ends of a DC power source, and is configured to supply an electric current to an LED light source including at least one LED element, to be connected in parallel with the capacitor; and a controller configured to adjust luminance of the LED light source by turning on and off the switching element in accordance with a dimming signal corresponding to a dimming level, the controller comprising:

a current detection section configured to output a detection value of an inductor current flowing through the inductor during an ON period of the switching element;

a threshold generation section configured to generate a threshold value of the inductor current corresponding to the dimming level; and a switching control section configured to determine an OFF timing of the switching element based on comparison between the detection value and the threshold value of the inductor current, wherein the controller increases a period of a switching cycle of the switching element with decrease of the dimming level.

2. The LED lighting device as set forth in claim 1, wherein the controller is configured to determine a target value of the inductor current, based on comparison between the detection value and the threshold value, so that the target value is decreased when the detection value is larger than the threshold value, and the target value is increased when the detection value is smaller than the threshold value, and wherein the controller is configured to turn off the switching element when the detection value of the inductor current is equal to or larger than the target value.

3. The LED lighting device as set forth in claim 1, wherein the controller is configured to cause the switching element to turn on and off so that the inductor current flows in a discontinuous mode, the discontinuous mode approaching to a critical mode with increase of the dimming level.

4. The LED lighting device as set forth in claim 2, wherein the controller is configured to cause the switching element to turn on and off so that the inductor current flows in a discontinuous mode, the discontinuous mode approaching to a critical mode with increase of the dimming level.

5. The LED lighting device as set forth in claim 1, wherein the controller is configured to determine a target value of the inductor current corresponding to the dimming level based on the threshold value, wherein the controller further comprises a clock signal generation section configured to output a periodic clock signal, wherein the switching control section is configured to turn off the switching element when the detection value of the inductor current is equal to or larger than the target value, and turn on the switching element at the beginning of each cycle of the clock signal, and wherein the clock signal generation section is configured to lengthen a period of each cycle of the clock signal with decrease of the dimming level.

6. The LED lighting device as set forth in claim 1, wherein the controller is configured to determine a target value of the inductor current corresponding to the dimming level based on the threshold value, wherein the controller further comprises a timer section configured to count an elapsed time from the OFF timing of the switching element, wherein the switching control section is configured to turn off the switching element when the detection value of the inductor current is equal to or larger than the target value, and turn on the switching element when the elapsed time counted by the timer section reaches a predetermined timer time, and wherein the timer section is configured to increase the timer time with decrease of the dimming level.

7. An illuminating apparatus comprises:

the LED lighting device as set forth in claim 1; and an apparatus body for accommodating the LED light source to which electric current is supplied from the LED lighting device.

* * * * *